US006076714A

United States Patent [19]

Wyenn

[11] Patent Number: 6,076,714

[45] Date of Patent: Jun. 20, 2000

[54] HOCKEY HANGER

[76] Inventor: Joel Simeon Wyenn, 2272 Meadowside Dr., Thousand Oaks, Calif. 91362

[21] Appl. No.: 08/959,172

[22] Filed: Oct. 28, 1997

[51] Int. Cl.[7] ..... A47G 25/14

[52] U.S. Cl. ..... 223/85; 223/91

[58] Field of Search ..... 223/85, 91, DIG. 1, 223/DIG. 2, 88, 92, 93; 211/113

[56] References Cited

U.S. PATENT DOCUMENTS

| | | | |
|---|---|---|---|
| D. 209,799 | 1/1968 | Stubbs | D80/8 |
| 802,245 | 10/1905 | Taylor | 223/85 |
| 1,815,673 | 7/1931 | Kelly | 223/96 |
| 2,347,949 | 5/1944 | Hoffman | 223/96 |
| 2,454,944 | 11/1948 | Reynolds | 223/96 |
| 4,778,088 | 10/1988 | Miller | 223/91 |
| 4,863,043 | 9/1989 | Bowen | 211/113 |

*Primary Examiner*—Bibhu Mohanty

[57] ABSTRACT

An apparatus consisting of a length of Bungee Cord which is folded in half, at the point of fold is created a loop for use in hanging the apparatus utilizing a half hitch knot, to which is attached to each leg of the Bungee Cord are a series of 1" hand operated wood clamps which are then used to attach various pieces of sporting equipment/gear in order to allow for the complete air drying of the wet or damp equipment as well as reduce the chance for lost or misplaced equipment.

1 Claim, 1 Drawing Sheet

N.T.S.

N.T.S.

N.T.S.

HOCKEY HANGER

CROSS REFERENCE TO RELATED APPLICATIONS not applicable

STATEMENT REGARDING FEDERALLY SPONSORED RESEARCH OR DEVELOPMENT not applicable

REFERENCE TO MICROFICHE APPENDIX not applicable

BACKGROUND OF INVENTION

This invention relates to an apparatus to hang up the equipment/gear worn by a hockey player or player of any other sport which presents a need to be air dried to prevent bacteria, mold, mildew, foul odors and the potential loss or misplacement of equipment/gear between it's use in a game or practice in the smallest space possible.

Historically players would place their just used/worn equipment/gear into an equipment bag which is then closed by virtue of a zipper or other closure method and transported elsewhere to be stored until it's next use.

If the equipment/gear is then kept in an equipment bag, bacteria, mold, mildew, and foul odors are produced as the bye product of the player's perspiration which has soaked into the equipment/gear during it's use in the sporting event.

It has been shown that if the equipment/gear is allowed to be exposed to the air instead of remaining in a closed equipment bag, the perspiration/moisture drys out of the equipment/gear without the creation of bacteria, mold, mildew and foul odors.

The historical method for drying a player's equipment/gear has been the placement of the equipment/gear on the ground spread out in order to get the best possible circulation. This method creates the need for a significant amount of floor space and the inconvenience of the equipment/gear being maintained for an uncertain period of time until it is determined the equipment/gear has completely dried. The other problem encountered using this historical method is the potential for the loss or misplacement of the equipment/gear before it is repacked into the equipment bag.

The use of the Hockey Hanger allows for quick attachment of each piece of equipment/gear either just after the sporting event (which enables the user to transport their equipment already accounted for and prepared to be hung up at the site of storage) or where upon it's arrival at the site of storage awaiting the equipment/gears next use. The use of the Hockey Hanger allows the equipment/gear to be hung up in the smallest space possible off the floor. The use of the Hockey Hanger allows for the circulation of air around each piece of equipment/gear thus eliminating bacteria, mold, mildew and foul odors.

BRIEF SUMMARY OF THE INVENTION

This invention is directed at solving the age old problems of foul smelling and wearing potentially unhealthy hockey and sporting equipment/gear as well as protect against lost or misplaced equipment/gear.

The object of the invention is to provide a quick method of attachment to a hanging apparatus that will withstand continuous use which can be easily secured/held up to hold a players equipment/gear and allow it to successfully and quickly air dry as well as prevent against the loss and misplacement of the equipment/gear.

DETAILED DESCRIPTION OF THE INVENTION

Figure 3:
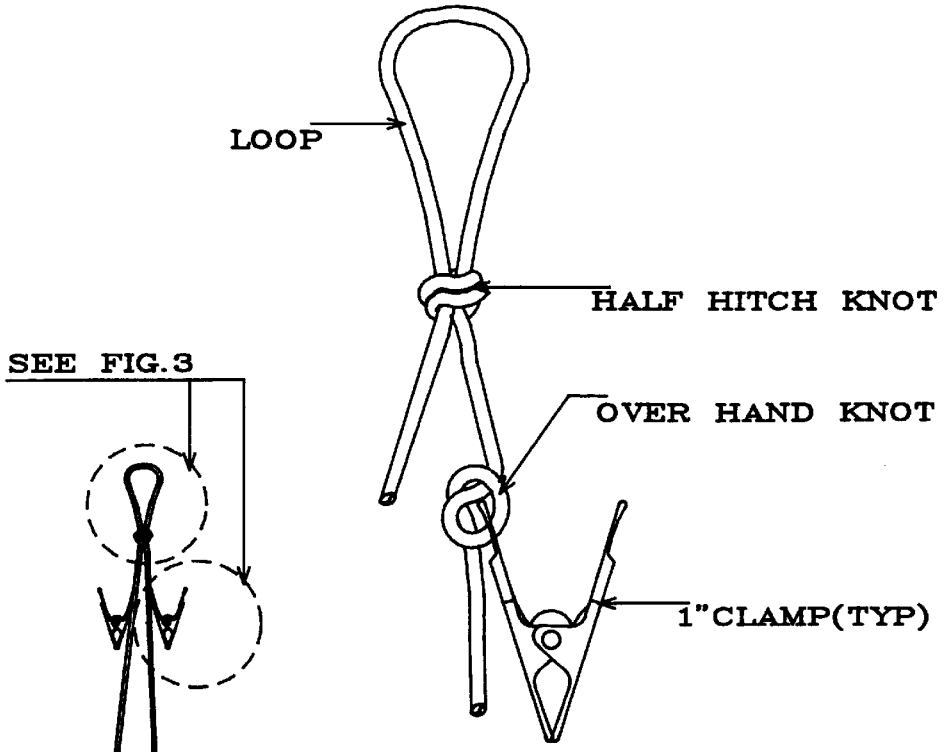
FIG. 3 depicts the loop formed by the half hitch knot at the top of the apparatus and the attachment of a 1" wood clamp to a leg of the Bungee Cord.
Figure 1:
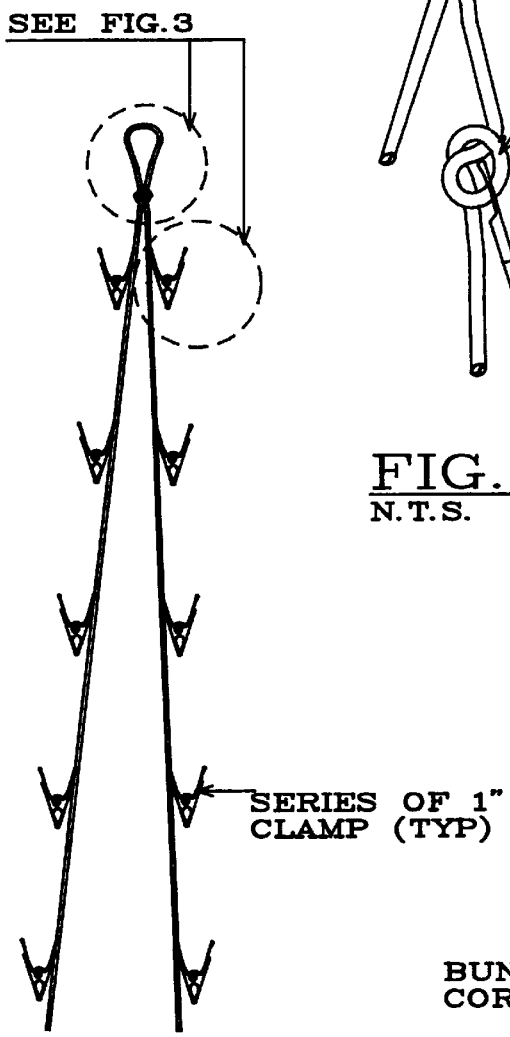
FIG. 1 is a perspective view of the Hockey Hanger showing it's component parts fully assembled; including Bungee Cord and clamps. Please note a half hitch knot is used to form a loop at the top of the apparatus for the purpose of hanging the apparatus.
Figure 2:
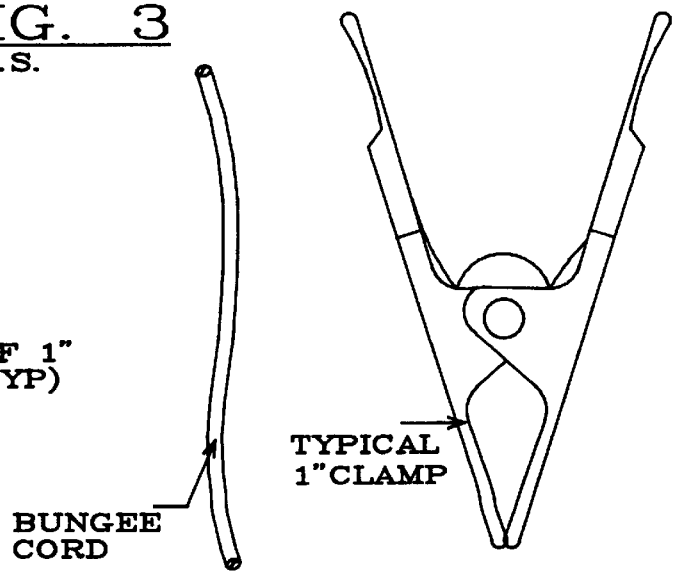
FIG. 2 depicts the apparatus components including the Bungee Cord and clamps.

Referring to FIG. 1 the Hockey Hanger is used to secure and hold hockey and other sports equipment/gear to allow it to air dry quickly and completely while using the smallest space possible to do so and prevent the loss or misplacement of the equipment during the interval between games or practices.

The apparatus is assembled from ¼" Bungee Cord and 1" wood hand clamps spaced apart to allow for the attachment of the equipment/gear in a fashion that as the Bungee Cord is weighted with subsequent pieces of equipment/gear it stretches thus allowing for the additional pieces of attached equipment/gear to be exposed and receive air circulation while all hanging together.

The assembling of the apparatus is accomplished by using a length of Bungee Cord, folding the Bungee Cord in half, creating a center loop at the point of fold and making a half hitch knot to be used for hanging the apparatus and then attaching a series of hand operated wood clamps in a predetermined spacing/separated fashion to each leg of the Bungee Cord by inserting the Bungee Cord through a hole in the handle of each hand operated wood clamp and making an overhand knot to secure each clamp in place.

In order to use the apparatus, the edge or a small potion of one or more pieces of sporting equipment/gear should be inserted between the jaws of the hand operated wood clamp by squeezing the handles of the wood clamp together and releasing the handles when the desired amount of sporting equipment has been inserted. When the desired number of hand operated wood clamps have been utilized the apparatus can be hung up by various means to allow for the tethered equipment/gear to hang freely off the ground or if the attachment of equipment/gear is completed while the apparatus is already hanging, no further activity is necessary to allow for the process of air drying to take place. The apparatus can be attached to a secured hook, a secured piece of rope, a properly bent coat hanger or any other suitable means of attachment.

What is claimed is:

1. A device for suspending garments and athletic equipment comprising a bungee cord with a knot tied in the middle section forming a loop to suspend the device from a support, with two sections of the bungee cord hanging downward therefrom the knot, the device further comprising a plurality of clamps attached to each of the two sections of the bungee cord to support garments and sporting equipment.

* * * * *